US006891322B2

(12) United States Patent
Lee et al.

(10) Patent No.: US 6,891,322 B2
(45) **Date of Patent: *May 10, 2005**

(54) FILTER LAYER FOR A DISPLAY, A METHOD OF PREPARING A FILTER LAYER FOR A DISPLAY AND A DISPLAY INCLUDING A FILTER LAYER

(75) Inventors: Jong-Hyuk Lee, Yongin (KR); Yoon-hyung Cho, Seoul (KR); Hae-Seung Lee, Seoul (KR); Dong-Sik Zang, Suwon (KR); Jung-Hwan Park, Seoul (KR)

(73) Assignee: Samsung SDI, Co., Ltd., Suwon-si (KR)

( * ) Notice: Subject to any disclaimer, the term of this patent is extended or adjusted under 35 U.S.C. 154(b) by 32 days.

This patent is subject to a terminal disclaimer.

(21) Appl. No.: 10/053,553

(22) Filed: Jan. 24, 2002

(65) Prior Publication Data

US 2002/0140339 A1 Oct. 3, 2002

(30) Foreign Application Priority Data

Feb. 6, 2001 (KR) ..... 2001-5718

(51) Int. Cl.[7] ..... H01J 29/30; H01J 61/40

(52) U.S. Cl. ..... 313/466; 313/112; 313/478; 313/586; 313/587; 313/371

(58) Field of Search ..... 313/466, 478, 313/474, 112, 582–587, 371; 428/546, 402, 434, 328, 209; 348/835; 359/885, 308, 443

(56) References Cited

U.S. PATENT DOCUMENTS 4,019,905 A 4/1977 Tomita et al.
4,132,919 A 1/1979 Maple (Continued)

FOREIGN PATENT DOCUMENTS

JP 0 848 386 6/1998
JP 0 890 974 1/1999
WO WO 99 01883 1/1999

OTHER PUBLICATIONS

*Society of Information and Display Digest*, 1995, pp 25–27, 5.1: *Invited Paper: "Microfilter"™ Color CRT*, Itou et al.

*J. Opt. Soc. Am. B*, vol. 3, No. 12/Dec. 1986, pp 1647–1655, *Optical nonlinearities of small metal particles: surface–mediated resonance and quantum size effects*, Hache et al.

U.S. Appl. No. 09/577,881 to Lee et al., filed on May 25, 2000.

U.S. Appl. No. 09/559,523 to Lee et al., filed on Apr. 28, 2000.

Office Action dated Jan. 19, 2001 for U.S. Appl. No. 09/559,523(Paper No. 4).

Amendment filed in Apr. 2001, responsive to Jan. 19, 2001 Office Action, for U.S. Appl. No. 09/559,523.

Office Action dated Jul. 3, 2001 for U.S. Appl. No. 09/559, 523 (Paper No. 7).

Amendment filed in Sep. 2001, responsive to Jul. 3, 2001 Office Action, for U.S. Appl. No. 09/559,523.

Notice of Allowance dated Jan. 23, 2002 for U.S. Appl. No. 09/559,523.

*Primary Examiner*—Ashok Patel
(74) *Attorney, Agent, or Firm*—Robert E. Bushnell, Esq.

(57) ABSTRACT

A filter layer for a display and a method of preparing the filter layer, and a display including the filter layer, are provided. The filter layer for a display includes oxide particles and nano-sized metal particulates adhered to the surface of the oxide particles. A surface plasma resonance (SPR) phenomenon is triggered at the interface of the oxide/metal to selectively absorb light of at least one predetermined wavelength.

23 Claims, 13 Drawing Sheets

U.S. PATENT DOCUMENTS 4,157,215 A 6/1979 Hanak
4,822,673 A 4/1989 Umemura
5,068,568 A 11/1991 de Vrieze et al.
5,179,318 A 1/1993 Maeda et al.
5,200,667 A 4/1993 Iwasaki et al.
5,218,268 A 6/1993 Matsuda et al.
5,315,209 A 5/1994 Iwasaki
5,396,148 A * 3/1995 Endo et al. ..... 313/479
5,627,429 A 5/1997 Iwasaki
5,756,197 A 5/1998 Statz et al.
5,874,801 A 2/1999 Kobayashi et al.
6,008,582 A * 12/1999 Asano et al. ..... 313/582
6,090,473 A 7/2000 Yoshikawa et al.
6,093,349 A * 7/2000 Ihara et al. ..... 252/584
6,143,418 A 11/2000 Takamiya et al.
6,366,012 B1 * 4/2002 Lee et al. ..... 313/466
6,479,928 B1 * 11/2002 Lee et al. ..... 313/461
6,577,061 B2 * 6/2003 Sano et al. ..... 313/582

* cited by examiner

FILTER LAYER FOR A DISPLAY, A METHOD OF PREPARING A FILTER LAYER FOR A DISPLAY AND A DISPLAY INCLUDING A FILTER LAYER

CLAIM OF PRIORITY

This application makes reference to, incorporates the same herein, and claims all benefits accruing under 35 U.S.C. §119 from our application A FILTER FOR A DISPLAY, A METHOD FOR PREPARING THE SAME AND A DISPLAY COMPRISING THE SAME filed with the Korean Industrial Property Office on 6 Feb. 2001 and there duly assigned Ser. No. 5718/2001.

BACKGROUND OF THE INVENTION

1. Field of the Invention

The present invention is related to a filter layer for displays, a method of preparing the same and displays including the same and, more particularly, to a light absorbing filter layer for improving contrast and color coordinate ranges of displays, a method of preparing the same and displays including the same.

2. Description of the Related Art

A cathode ray tube (further referred to as CRT) is one of the present major image displays. As large display and high-resolution televisions are in demand, a light and thin flat panel display (FPD) with improved brightness has been developed actively. Examples of the FPD, are a liquid crystal display (LCD), an electroluminescent display (ELD), a field emitter display (FED), a plasma display panel (PDP) and so on.

The CRT is a display for color images that emits stripe-type or dot-type red (R), green (G) and blue (B) phosphors of a phosphor screen on which the electron beams radiated from an electron gun collide. The phosphor screen is prepared by forming phosphor layers between light-absorbing black matrix layers on a face panel.

FIG. 1 illustrates a partial cross-sectional view of the face panel with a coated phosphor layer of a conventional CRT. A conventional CRT, as illustrated in FIG. 1, for example, includes two sources of visible light coming out of the face panel. One is a light L1 emitted from phosphors (R,G,B) when electron beams impinge on them. The other is external ambient light reflected from the face panel 10. The reflected light has in turn two components depending on where the incident external light is reflected. A first component L2 is reflected light on the surface of the face panel 10. A second component L3 is the light that passes the face panel 10 and then is reflected off at the interface of the phosphor screen 2 and the inner surface of the face panel 10.

As the CRT is designed to emit light at only predetermined wavelengths and to display a color image by a selective combination of these predetermined wavelengths, the ambient light reflected from the face panel has a uniform continuous spectrum and has different wavelengths from the predetermined wavelengths, thus degrading the contrast of a CRT.

FIG. 2 illustrates spectral luminescence curves of P22 phosphor materials commonly used in the art. Blue phosphor ZnS:Ag, green phosphor ZnS:Au,Cu,Al and red phosphor $Y_2O_2S$:Eu have their peak wavelengths curves 21 to 23 of FIG. 2 at 450 nm, 540 nm and 630 nm, respectively.

The light components L2 and L3, reflected from external ambient light have relatively higher illumination between these peaks 21 to 23 of FIG. 2, since their spectral distribution is continuous across all the visible wavelengths. The spectrum of light emitted from the blue and green phosphor has relatively broad bandwidths and thus some of wavelengths, from 450 nm to 550 nm, overlap with each other. The spectrum of red phosphor has undesirable side bands around 580 nm, at which wavelength the luminous efficiency is high. Therefore, selective absorption of light in the overlapping wavelengths between blue and green phosphor at and around 450 nm to 550 nm would greatly improve color purity of a CRT without sacrificing the luminescence efficiency of phosphors.

Also, because absorption of light around 580 nm makes the body color of a CRT appear bluish, external ambient light around 410 nm is preferably made to be absorbed in order to At compensate for the bluish appearance.

Efforts have been made to find a way to selectively absorb light around 580 nm, 500 nm and 410 nm in order to provide a CRT with improved brightness. For example, U.S. Pat. Nos. 5,200,667 to Iwasaki et al., 5,315,209 to Iwasaki and 5,218,268 to Matsuda et al. disclose forming a film including dyes or pigments that selectively absorb light on a surface of the outer surface of the phosphor screen. Alternatively, a plurality of transparent oxide layers having different refractive index and thickness have been coated on the outer surface of a face panel to take advantage of their light interference for the purpose of reducing ambient light reflection. However, there is also a need to reduce light reflected at the phosphor layer and at the inner surface of face panel.

In relation to the problem as described above, U.S. Pat. Nos. 4,019,905 to Tomita et al., 4,132,919 to Maple and 5,627,429 to Iwasaki relate to an intermediate layer including organic or inorganic pigments or dyes with absorbability of light at predetermined wavelengths that is coated between the inner surface of the face panel and the phosphor layer. While such a technique can be advantageous with respect to the application of a manufacturing process of a CRT, the dyes and pigments used in the intermediate layer typically have a broad absorption wavelength and, thus, the contrast of the CRT generally does not improve significantly.

Also, U.S. Pat. Nos. 5,068,568 to de Vrieze et al. and 5,179,318 to Maeda et al. disclose an intermediate layer including layers of a high refractive index and a low refractive index alternately between the inner surface of the face panel and the phosphor layer. Further, a method of forming a corresponding filter layer on an RGB phosphor layer is described in *SOCIETY OF INFORMATION AND DISPLAY DIGEST,* "5.1 Invited Paper: "Microfilter"™ Color CRT", Itou et al., 1995 pages 25–27. However, this method typically needs additional equipment and a modification of the manufacturing process, since coating, light exposing and developing processes for the corresponding filter layer are typically further conducted compared to a conventional technique.

Additionally, U.S. Pat. No. 6,090,473 to Yoshikawa et al. discloses a plasma display panel including a face panel to which a glass plate or film is adhered so as to improve contrast and shield an electron wave.

SUMMARY OF THE INVENTION

An objective of the present invention is to provide a filter layer to improve the contrast of a display by absorbing light in the overlapping wavelengths among red (R), green (G) and blue (B) phosphors.

It is another object of the present invention to provide a method of preparing a filter layer of a display.

It is a further object of the present invention to provide a display including a filter layer.

The above and other objects of the present invention can be achieved by a filter layer for a display including oxide particles and nano-sized metal particulates adhered to a surface of the is oxide particles. A surface plasma resonance (SPR) phenomenon is triggered at the interface of the oxide/metal to selectively absorb light with predetermined wavelengths.

Also, to achieve the above and other objects of the present invention, the present invention provides a method of preparing a filter layer including the steps of: a) dispersing an oxide in water to form an oxide sol; b) adding a metal salt, a reducing agent, and a dispersing agent to an organic solvent to prepare a metal colloid solution; c) mixing the oxide sol with the metal colloid solution to prepare a coating solution with metal colloid of the metal colloid solution being dispersed in the oxide sol; d) applying the coating solution on a face panel to form a filter layer; and e) drying the filter layer at room temperature.

Further, the present invention provides a display including the filter layer prepared by the above described method of preparing a filter layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
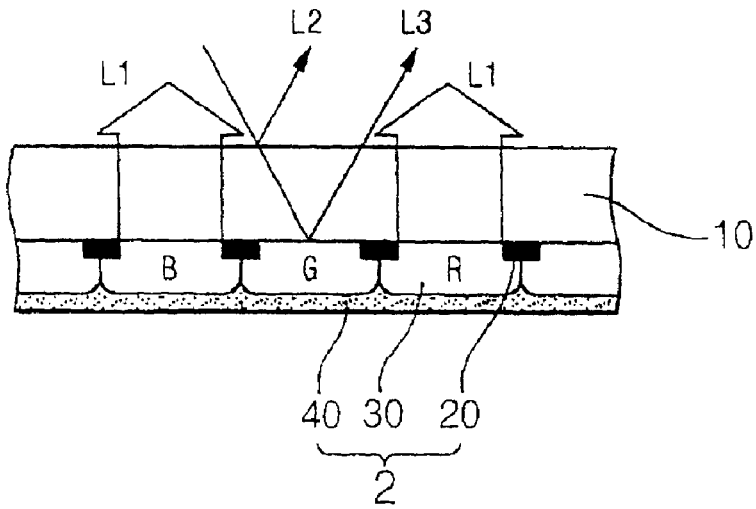
FIG.1 (PRIOR ART)
FIG. 1 illustrates a partial cross-sectional view of a conventional CRT face panel.

FIG. 1 illustrates a partial cross-sectional view of the face panel 10 with a coated phosphor layer or phosphor screen 2 of a conventional CRT. The phosphor screen 2 includes a black matrix 20, a phosphor layer 30 and a metal reflection layer 40. There are two sources of visible light coming out of the face panel 10. One is a light L1 emitted from phosphors of the phosphor layer 30 when electron beams impinge on them. The other is external ambient light reflected from the face panel 10. The reflected light has in turn two components depending on where the incident external light is reflected. A first component L2 is reflected light on the surface of the face panel 10. A second component L3 is the light that passes the face panel 10 and then is reflected at the interface of the phosphor screen and the inner surface of the face panel 10.

As the CRT is designed to emit light at only predetermined wavelengths and to display a color image by a selective combination of these predetermined wavelengths, the ambient light reflected from the face panel 10 has a uniform continuous spectrum, and has different wavelengths from the predetermined wavelengths, thus degrading the contrast of a CRT.

Figure 2:
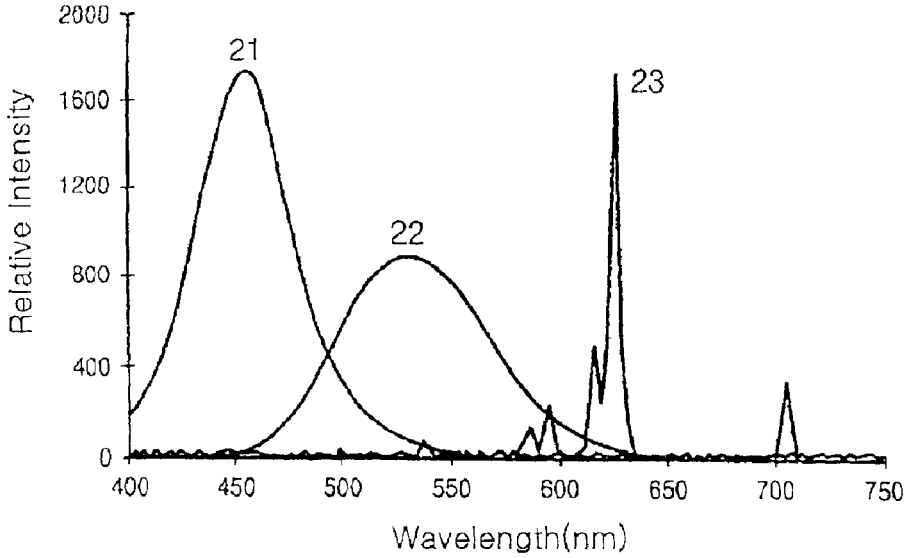
FIG.2 (PRIOR ART)
FIG. 2 is a graph showing spectral luminescence distributions of conventional phosphors.

FIG. 2 illustrates spectral luminescence curves of P22 phosphor materials commonly used in the art. Blue phosphor ZnS:Ag, green phosphor ZnS:Au,Cu,Al and red phosphor $Y_2O_2S$:Eu have their peak wavelengths curves 21 to 23 of FIG. 2 at 450 nm, 540 nm and 630 nm, respectively.

The light components L2 and L3 reflected from external ambient light have relatively higher illumination between these peaks 21 to 23 of FIG. 2 since their spectral distribution is continuous across all the visible wavelengths. The spectrum of light emitted from the blue and green phosphor has relatively broad bandwidths and thus some of wavelengths, from 450 nm to 550 nm, overlap with each other. The spectrum of red phosphor has undesirable side bands around 580 nm, at which wavelength the luminous efficiency is high. Therefore, selective absorption of light in the overlapping wavelengths between blue and green phosphor at 450 nm to 550 nm and around 580 nm would greatly improve color purity of a CRT without sacrificing the luminescence efficiency of phosphors.

Also, because absorption of light around 580 nm makes the body color of a CRT appear bluish, external ambient light around 410 nm is preferably made to be absorbed in order to compensate for the bluish appearance.

A filter layer of the present invention includes oxide particles and nano-sized metal particulates adhered to a surface of the oxide particles. A surface plasma resonance (SPR) phenomenon is induced at the interface of the oxide/metal to selectively absorb light with predetermined wavelengths.

The metal of the nano-sized metal particulates is selected from the group consisting of a transition metal, an alkali metal, an alkali earth metal, and mixtures thereof. Examples of the metal are Au, Ag, Pd, Pt, Cu, Ni, Sb, Sn, Zn, Zr, Se, Cr, Al, Ti, Ge, Fe, W, Pb or mixtures thereof. Among them, Au, Ag, Pd, Pt or mixtures thereof are preferable since these metals are capable of absorbing visible light.

As the oxide of the oxide particles, silica, titania, zirconia, alumina or mixtures thereof are preferably used. According to one example of the present invention, preferred combinations are silica/titania, alumina/zirconia, and alumina/titania in a mole ratio of 0.1–2.0/8.0–9.9, respectively.

A method of preparing a filter layer of the present invention includes: a) dispersing an oxide in water to form an oxide sol; b) adding a metal salt, a reducing agent, and a dispersing agent to an organic solvent to prepare a metal colloid solution; c) mixing the oxide sol with the metal colloid solution to prepare a coating solution with metal colloid being dispersed in the oxide sol; d) applying the coating solution on a face panel to form a filter layer; and e) drying the filter layer at room temperature.

In the above step b), the metal salt used in preparation of metal colloid solution can be a halide, a nitrate or the like of a metal selected from the group consisting of a transition metal, an alkali metal, an alkali earth metal, and mixtures thereof, for example. Preferred examples of the metal salt are $HAuCl_4$, $NaAuCl_4$, $AuCl_3$, $AgNO_3$ and the like.

An organic or inorganic reducing agent can be used as the reducing agent. Hydrazine ($H_2N_2$), sodium borohydride ($NaBH_4$), alcohol amine and so on, preferably, for example, can be used. The reducing agent can be added in a mole ratio of 0.1–100 on the basis of the metal colloid solution.

As the dispersing agent, an oligomer or a polymer organic compound can be used and is exemplified by polyvinylbutyral (PVB), polyvinylpyrrolidone (PVP), or polyvinylalcohol (PVA).

In a conventional process, an alkoxide is dispersed in an alcohol solvent to form an alkoxide sol, a metal salt is added to the alkoxide sol to prepare a coating solution, and the coating solution is applied on a face panel. In this process, sintering the filter layer at an elevated temperature is typically required before forming the phosphor layer. Through the thermal treatment of the sintering process, the metal salt is reduced to metal by pyrolysis and an alkoxide gel layer becomes a denser oxide layer. Additional explosion proof equipment is typically required because of the alcohol solvent. In this regard, using water instead of alcohol as a solvent has been researched, but it can be difficult to prepare a coating solution including water as a main component, since alkoxide hydrolyzes fast and is immiscible with water.

In the present invention, after the metal salt, the reducing agent, and the dispersing agent are added to an organic solvent, such as alcohol, to prepare a metal colloid in a reduced state as a metal particulate precursor, the metal colloid is mixed with an oxide sol dispersed in water to prepare a coating solution, and the coating solution is applied on a face panel and dried to form a filter layer. The filter layer is prepared through a drying process alone without a heat-treatment process, and explosion proof equipment is advantageously not required.

The filter layer of the present invention includes oxide particles and nano-sized metal particulates adhered to a surface of the oxide particles. A surface plasma resonance (SPR) phenomenon is induced at the interface of the oxide/metal to selectively absorb light with predetermined wavelengths. Surface plasma resonance (SPR) is a phenomenon where electrons on the surface of the nano-sized metal particulates adhering to the surface of oxide particles resonate in response to an electric field and absorb light in a particular bandwidth. See, for example, "*Optical Nonlinearitics of Small Metal Particles: Surface-mediated Resonance and Quantum Size Effects*", Hache et al., J. Opt. Soc. Am. B vol.3, No.12/Dec. 1986, pp 1647–1655, for details in this regard.

The filter layer applied on a face panel of a display absorbs light with overlapping wavelengths among RGB phosphors to improve contrast of the display by inducing an SPR phenomenon at the interface of the oxide/metal. For example, the filter formed on a face panel of a CRT improves the contrast of a CRT by absorbing light selectively with overlapping wavelengths among RGB phosphors and wavelengths around 580 nm, and by reducing reflection at an inner or an outer surface of a face panel.

The absorption intensity and the absorption peak wavelength depend on at least one factor selected from the group consisting of kinds or types, contents and size of metals, and kinds or types and contents of oxides. For example, for gold (Au), silver (Ag) and copper (Cu) particulates less than 100 nm in diameter adhered to silica, light is absorbed around the wavelengths of 530 nm, 410 nm and 580 nm, respectively. With platinum (Pt) or palladium (Pd), the light absorption spectrum is rather broad, from 380 nm to 800 nm, depending on the kind of oxide. Accordingly, a particular wavelength absorbed depends on the kind or type of oxide, i.e., its refractive index, a kind or type of metal, and a size of such metal particulates. It is known that the refractive index of silica, alumina, ziroconia and titania are 1.52, 1.76, 2.2 and 2.5–2.7, respectively.

In the present invention, the metal particulates are nano-sized particulates desirably within the range of above 1 nm and less than 10 nm. However, for the present invention, "nano-sized" is defined from several nanometers to hundreds of nanometers. In other words, a "nano-sized particulate" is a particulate greater than 1 nanometer but less than 1 micrometer in diameter. Generally, as the size of metal particulates increases until it reaches 100 nm, its absorption intensity tends to increase. Above 100 nm, as the size increases the absorption peak moves toward long wavelengths. Accordingly, the size of the metal particulates affects both the absorption intensity and the absorption peak wavelength.

The absorption intensity is also maximized by controlling the number of the metal particulates (contents of the metal particulates) or the contact efficiency between the metal particulates and the oxide particles, as well as the size of the metal particulates. Accordingly, the absorption intensity depends on the size and contents of the metal particulates. Additionally, the amount of oxide that is added as a second oxide has an effect on the absorption intensity.

In the present invention, a preferred amount of metal particulates is 0.001 to 0.5 mole percent (%) on the basis of oxide particles. When the amount of the metal particulates falls within this range, the desired light absorption peak wavelength and absorption intensity can be obtained.

For example, a filter with gold (Ag) particulates and silica particles has an absorption peak at 530 nm. This filter can be made to absorb light around 580 nm by the following methods. One method is to add a second oxide material, such as titania, alumina or zirconia, for example, having a greater refractive index than silica so that its absorption peak moves toward a longer wavelength. An amount of the added oxide material as a second component will determine the absorption intensity. The intensity of an absorption peak should be set taking into account the transmission efficiency of a glass panel and the density of the filter. Generally, it is preferable that the shapes of the absorption peaks be sharp and that the absorption intensity be large. A second method is to increase the size of the metal (gold) particulates without addition of a second oxide material. When a coating solution composed of metal colloids dispersed in an oxide sol is applied on a surface of the glass panel, and a coating filter layer is formed through a sol-gel process, the metal particulates are coated and adhered to the surface of an oxide particle. The size of the metal particulates can be controlled by varying the kinds, or types, or amounts of a reducing agent. For instance, the more the reducing agent, or the stronger the reducing power added, the larger the particulates become.

For example, a filter with Au/titania-alumina or Au/zirconia-alumina has an intensive absorption peak at 575 nm. This absorption peak corresponding to a bandwidth between green and red phosphor has a high luminous efficiency and can improve the contrast and color purity of a display. In addition, a metal/oxide combination that absorbs light around a 580 nm wavelength can contain metal particulates that are capable of absorbing light of a 410 nm wavelength, since the light around 410 nm is preferably further absorbed in order to compensate for a bluish appearance.

A filter layer with a metal and an oxide combination as in the present invention can improve the contrast and color purity by being applied to various displays, such as a CRT or FPD, for example, according to the optical characteristics and the manufacturing process of the display. The filter layers of the present invention can contain more than two kinds of metals or oxides with differing absorption peak wavelengths. A plurality of the filter layers with differing absorption peak wavelengths can also be formed according to the present invention.

Preferred embodiments of the present invention will now be described in detail with reference to the accompanying drawings, particularly FIGS. 3 through 20, with the same numeral being used in the drawings to denote the same element throughout the specification.

Figure 3:
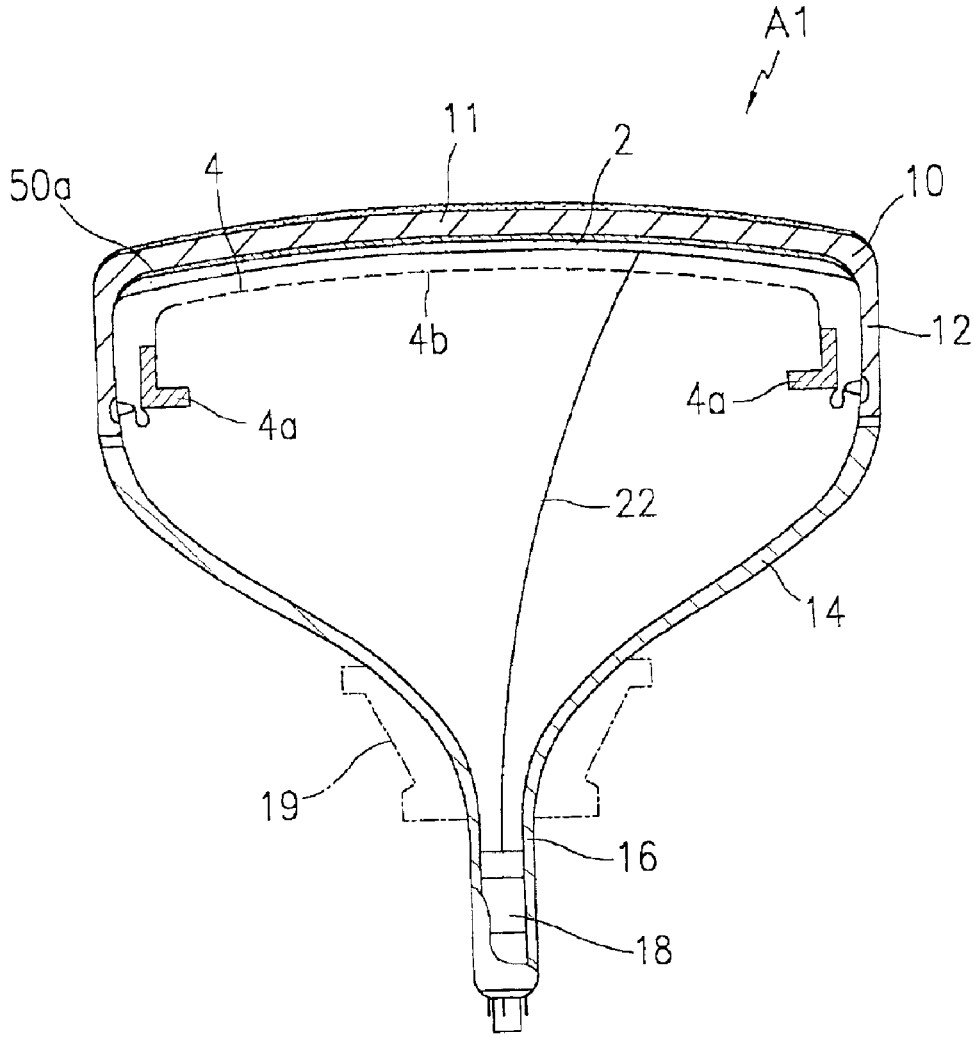
FIG. 3 illustrates a cross-sectional view of a CRT face panel according to an embodiment of the present invention.

In one preferred embodiment, the filter layer is formed on the inner surface of a face panel 10 of a CRT A1, and such embodiment is shown in FIG. 3. As illustrated in the drawing of FIG. 3, the CRT A1 includes a face panel 10 defining a front exterior of the CRT A1, and a funnel 14 joined to the face panel 10 to define a rear exterior of the CRT A1. The face panel 10 includes a display portion 11 defining a distal end of the face panel 10 and a curved lateral wall 12 that extends from the display portion 11 toward the funnel 14 having an end joined to the funnel 14. The funnel 14 includes a neck 16 which is formed on an end of the funnel 14 opposite to the end joined to the face panel 10, and an electron gun 18 disposed within the neck 16 of the funnel 14.

Continuing with reference to FIG. 3, a phosphor screen 2 is formed on an inner surface of the display portion 11 of the face panel 10. The phosphor screen 2 includes a black matrix layer 20, made of a light-absorbing graphite compound, a phosphor layer 30 including red (R), green (G) and blue (B) phosphor pixels, and a metal reflection layer 40 (see FIGS. 4A–10). A mask frame 4*a* is attached to the lateral wall 12, and a shadow mask 4 is connected to the mask frame 4*a* to be suspended substantially parallel to and at a predetermined distance from the phosphor screen 2.

The electron gun 18 radiates red (R), green (G) and blue (B) electron beams 22 in a direction toward the face panel 10. The RGB electron beams 22 are controlled by image signals such that the beams are deflected to specific pixels by an electrical field generated by a deflection yoke 19. The deflection yoke 19 is disposed on an outer circumference of the funnel 14. The deflected electron beams 22 pass through apertures 4*b* of the shadow mask 4 to land on specific RGB phosphor pixels of the phosphor screen 2 such that a color selection of the electron beams 22 by the shadow mask 4 is realized. Accordingly, the RGB phosphors of the phosphor screen 2 are illuminated for the display of color images.

Figure 4A:
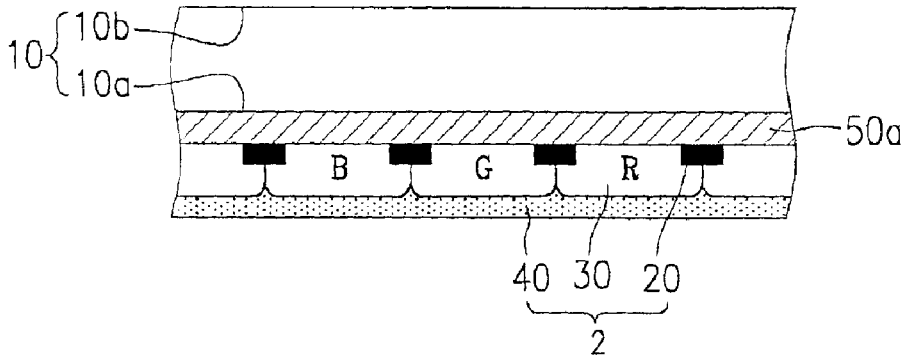
FIGS. 4A and 4B are a partial cross-sectional views of a CRT face panel according to respective embodiments of the present invention of the CRT face panel of FIG. 3.

FIG. 4A illustrates a partial cross-sectional view of a CRT, such as CRT A1 of FIG. 3, of the present invention, including: a face panel 10; at least one filter layer 50*a*, formed on the inner surface 10*a* of the face panel 10, filter layer 50*a* including nano-sized minute metal particulates adhered to a surface of oxide particles, the filter layer 50*a* providing at least one selective absorption peak for light at a predetermined wavelength of light by the induction of the surface plasma resonance (SPR) phenomenon at the interface between the metal particulates and the oxide particles; and a phosphor layer 30 formed on the at least one filter layer 50*a*.

Figure 4B:
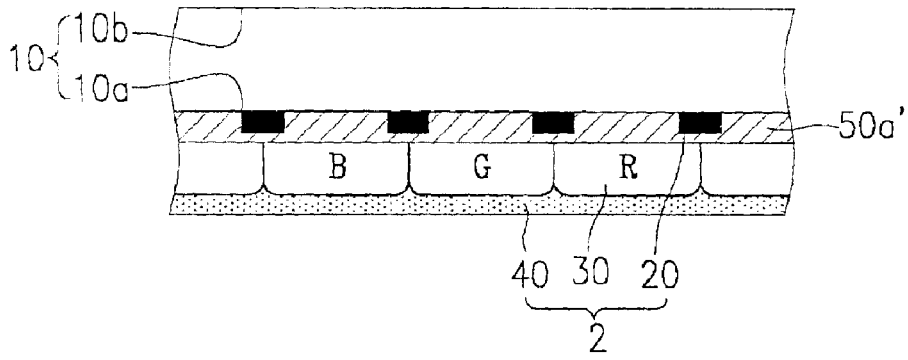

FIG. 4B illustrates a partial cross-sectional view of a CRT, such as CRT A1 of FIG. 3, of another embodiment of the present invention where the black matrix layer 20 is formed prior to coating of a filter layer 50*a*' having the same or similar characteristics as filter layer 50*a* of FIG. 4A. In other words, the filter layer 50*a* or 50*a*' is formed before or after black matrix layer 20 is patterned among the red, green and blue phosphors. This embodiment of FIG. 4*b* illustrates that when the black matrix layer 20 is formed is not critical in the present invention. An intermediate layer can be disposed on the red, green and blue phosphor layers to flatten the same, as necessary.

Figure 5:
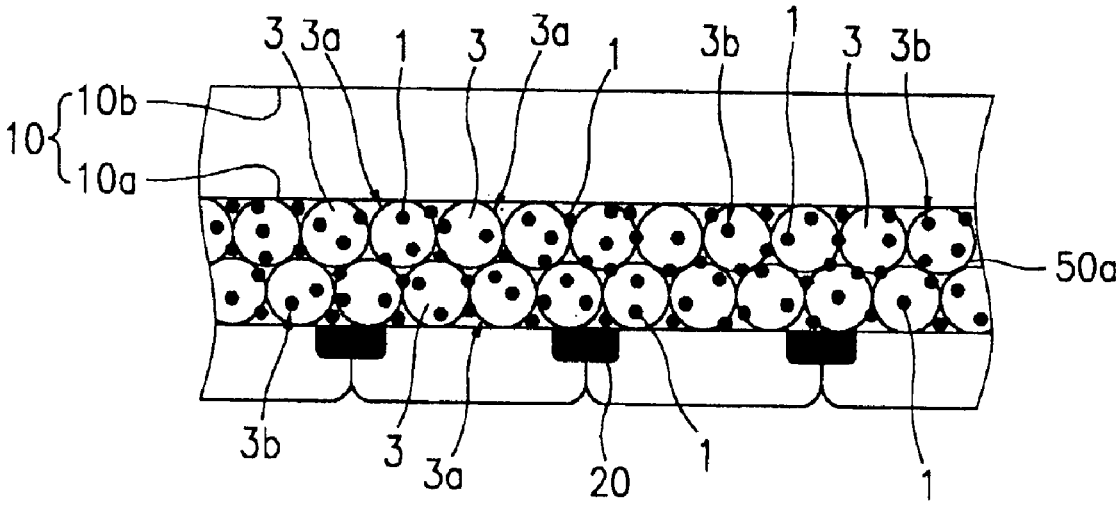
FIG. 5 is a partial cross-sectional view of a filter layer of a CRT face panel according to the present invention.

FIG. 5 illustrates the structure of a filter layer 50*a* according to the present invention including nano-sized minute metal particulates 1 adhered to a surface 3*a* of oxide particles 3. A surface resonance phenomenon (SPR) occurs at the corresponding interfaces 3*b* between the metal particulates 1 and the oxide particles 3 to selectively absorb light at least at one predetermined wavelength of light. The filter layers of the present invention described before and hereinafter described have the same or similar structures as that illustrated in FIG. 5.

Also, the filter layer 50*a* or 50*a*' on the inner surface 10*a* of the face panel 10 can include more than two kinds of metals and oxides with differing absorption peak wavelengths for light.

Figure 6:
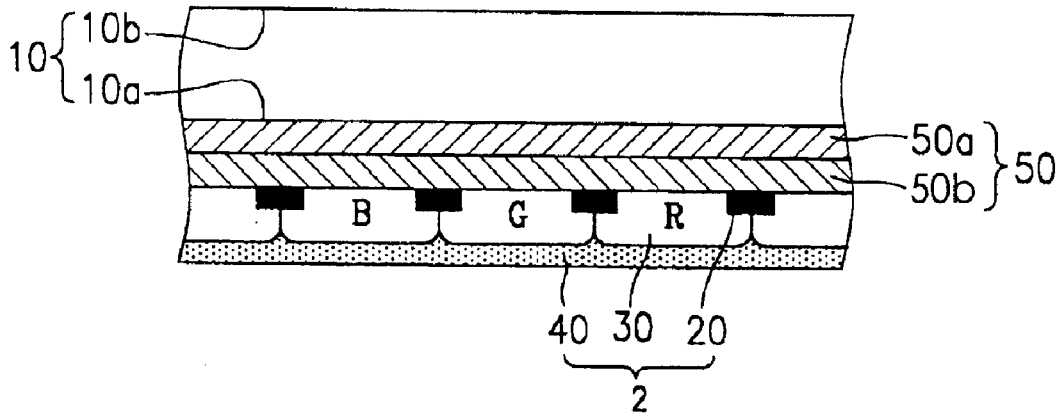
FIG. 6 is a partial cross-sectional view of a CRT face panel according to another embodiment of the present invention.

Further, a plurality of the filter layers can be formed in the present invention. FIG. 6 illustrates a partial cross-sectional view of a CRT, such as CRT A1 of FIG. 3, of such embodiment including a plurality of filter layers 50, such as the two filter layers 50*a* and 50*b* of FIG. 6. Each of the filter layers 50*a*, 50*b* can be different in terms of at least one factor selected from the group consisting of the sizes and kinds, or types, of the metal particulates and the kinds, or types, and contents of the oxide particles, such that ambient light of more than two different wavelength ranges, around 580 nm, and around 500 nm or 410 nm for example, can be absorbed.

One of the filter layers 50*a,* 50*b* can provide an absorption peak for light at 580 nm while the other filter layer 50*a,* 50*b* can provide an absorption peak for light at 500 nm or 410 nm, for example. The order in which a plurality of different filter layers 50*a,* 50*b* is layered does not matter, so that the order of the filter layers 50*a,* 50*b* can be switched. While FIG. 6 only shows two layers of filter layers 50*a,* 50*b,* more than two filter layers can be employed for absorbing an additional wavelength or wavelengths of light according to the present invention.

Figure 7:
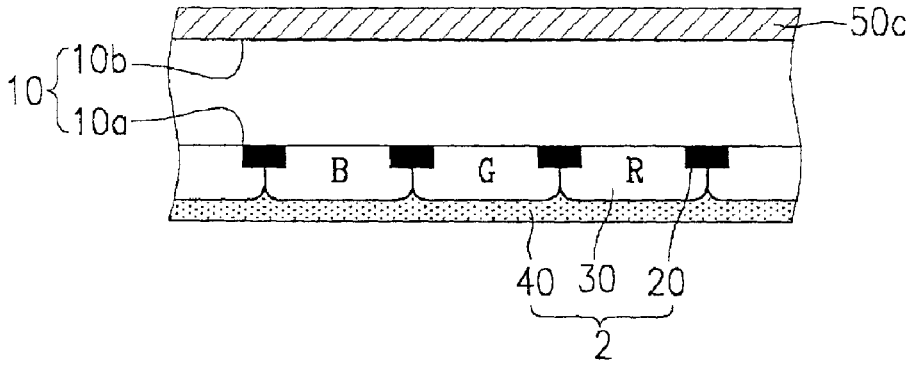
FIG. 7 is a partial cross-sectional view of a CRT face panel according to another embodiment of the present invention.

In another preferred embodiment of the present invention, the filter layer is formed on an outer surface of face panel of a CRT, and such embodiment is illustrated in FIG. 7.

FIG. 7 is a partial cross-sectional view of a CRT, such as CRT A1 of FIG. 3, including: a face panel 10; at least one filter layer 50*c,* formed on an outer surface 10*b* of the face panel 10, the filter layer 50*c* including nano-sized minute metal particulates adhered to a surface of oxide particles, the filter layer 50*c* providing at least one selective absorption peak for light at a predetermined wavelength of light by the induction of a surface plasma resonance (SPR) phenomenon at the interface between the metal particulates and the oxide particles; and a phosphor layer 30 formed on the inner surface 10*a* of the face panel 10. The filter layer 50*c* with minute metal particulates adhered to the surface of the oxide particles reduces light reflection on the outer surface 10*b* of the face panel 10.

The filter layer 50*c* of FIG. 7 on the outer surface 10*b* of the face panel 10 can include more than two kinds of metals and oxides with differing absorption peak wavelengths for light. Also, more than two filter layers can be applied on the outer surface 10*b* of the face panel 10, respectively including absorption peaks at different wavelengths of light, similar to the plurality of filter layers 50*a,* 50*b* of FIG. 6.

Figure 8:
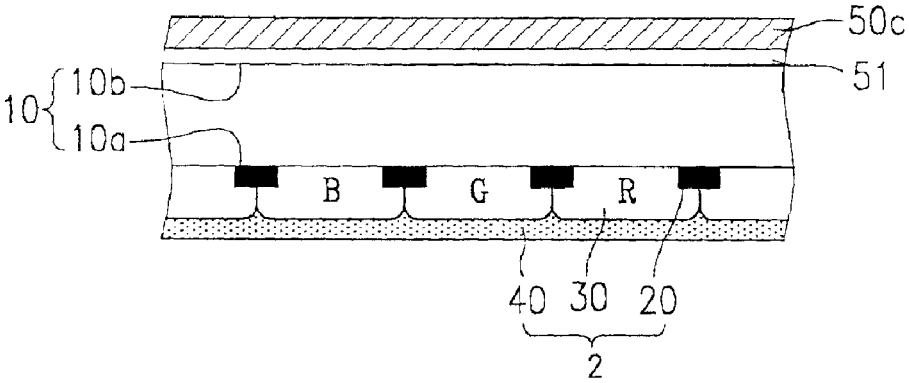
FIG. 8 is a partial cross-sectional view of a CRT face panel according to another embodiment of the present invention.

FIG. 8 illustrates a cross-sectional view of a CRT, such as CRT A1 of FIG. 3, according to an embodiment of the present invention, including a face panel 10 with a conductive film 51 for preventing static from being disposed on the outer surface 10*b* of the face panel 10 between the face panel 10 and the filter layer 50*c*. A protective layer or anti-reflection layer can be formed on the conductive film 51. Generally, the conductive film 51 includes indium tin oxides (ITO) and the anti-reflection layer is made of silica. According to the present invention, minute metal particles are added to a silica sol prior to forming of the silica anti-reflection layer. Thus, the anti-reflection layer advantageously serves an extra function of selective light absorption.

Figure 9:
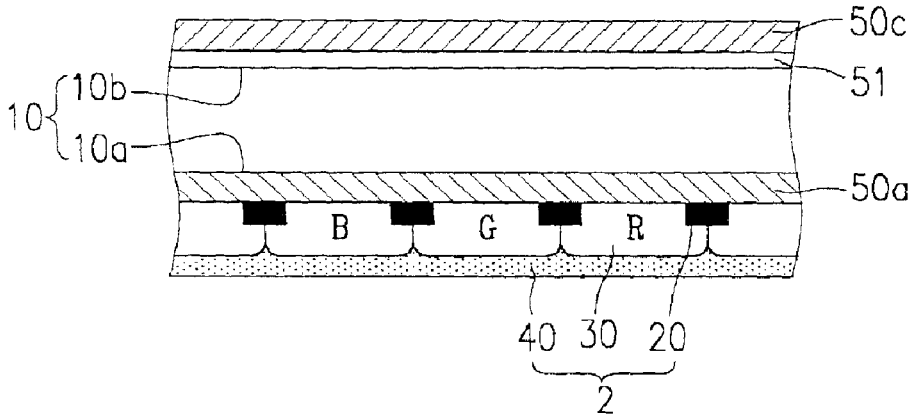
FIG. 9 is a partial cross-sectional view of a CRT face panel according to another embodiment of the present invention.

In another preferred embodiment of the present invention, the filter layer is formed on both the inner and outer surfaces of a face panel of a CRT, and such embodiment is illustrated in FIG. 9.

FIG. 9 is a partial cross-sectional view of a CRT according to the present invention, such as CRT A1 of FIG. 3, including: a face panel 10; at least one of a first filter layer 50*a,* formed on the inner surface 10*a* of the face panel 10; at least one of a second filter layer 50*c,* formed on or over the outer surface 10*b* of the face panel 10; and a phosphor layer 30 , formed on the first filter layer 50*a*. The first filter layer 50*a* and second filter layer 50*c* include nano-sized minute metal particulates adhered to a surface of oxide particles, and the filter layers 50*a,* 50*c* respectively provide at least one selective absorption peak for light at a predetermined wavelength of light by the induction of a surface plasma resonance (SPR) phenomenon at the interface between the metal particulates and the oxide particles. Also, a conductive film 51 for preventing static can also be disposed between the outer surface 10*b* of the face panel 10 and the filter layer 50*c*.

Figure 10:
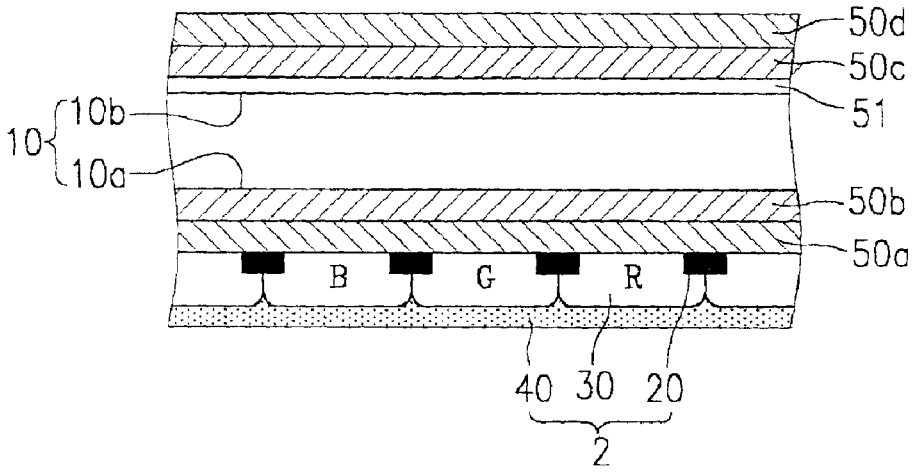
FIG. 10 is a partial cross-sectional view of a CRT face panel according to another embodiment of the present invention.

Also, the filter layers 50*a,* 50*c* on the surface of the face panel 10 can include more than two kinds of metals and oxides with differing absorption peak wavelengths for light. As shown in the partial-cross sectional view of a CRT, such as CRT A1 of FIG. 3, according to the present invention of FIG. 10, a plurality of or more than two filter layers 50*a,* 50*b,* 50*c,* 50*d* can be applied on or over the respective inner surface 10*a* and outer surface 10*b* of the face panel 10, providing absorption peaks for light respectively at different wavelengths of light. The filter layer 50*c* on the outer surface 10*b* of the face panel 10 can serve as an anti-reflection layer. A conductive film 51 for preventing static can be disposed between the outer surface 10*b* of the face panel 10 and the filter layer 50*c,* for example, as illustrated in FIG. 10.

The filter layer or filter layers of the present invention can also be applied to other types of displays, such as to a DC (direct current) type or AC (alternating current) type plasma display panel (PDP).

Figure 11:
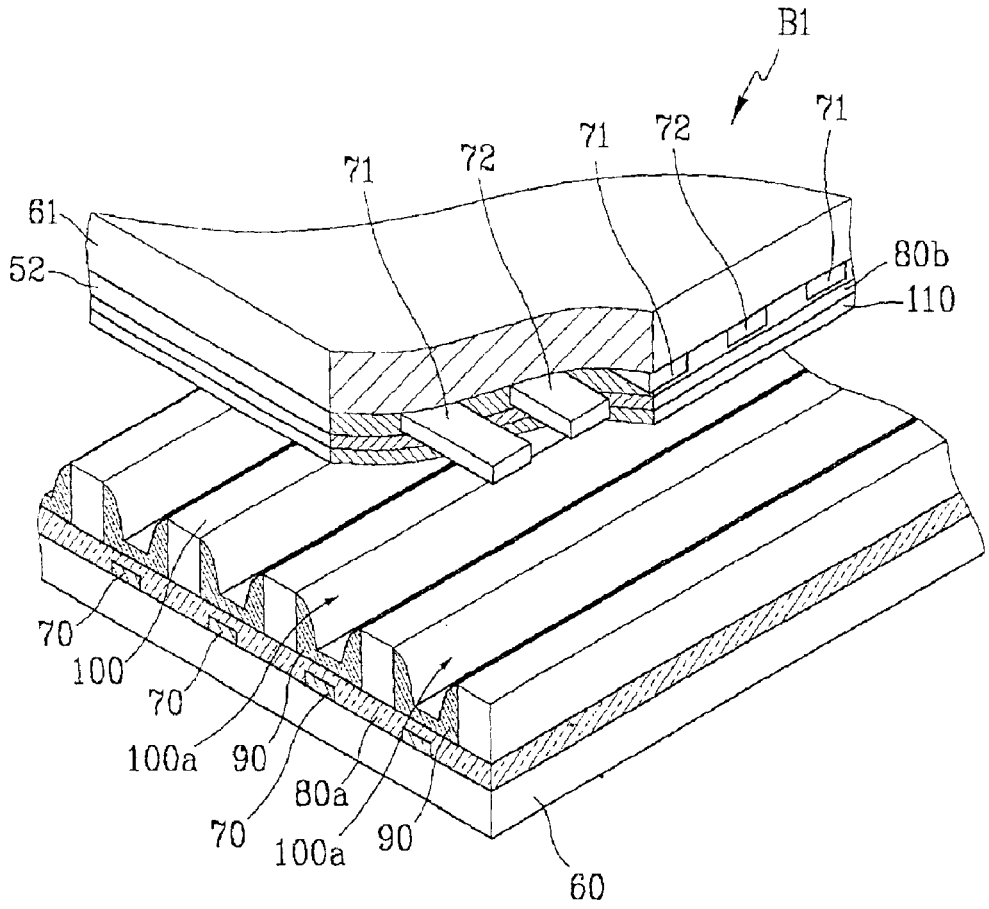
FIG. 11 is a partially exploded perspective view of a PDP according to an embodiment of the present invention.

In another preferred embodiment of the present invention, the filter layer is formed on a front substrate of a PDP. FIG. 11 illustrates a partially exploded perceptive view of such embodiment according to the present invention and FIG. 12 illustrates a cross-sectional view of the embodiment of FIG. 11.

Figure 12:
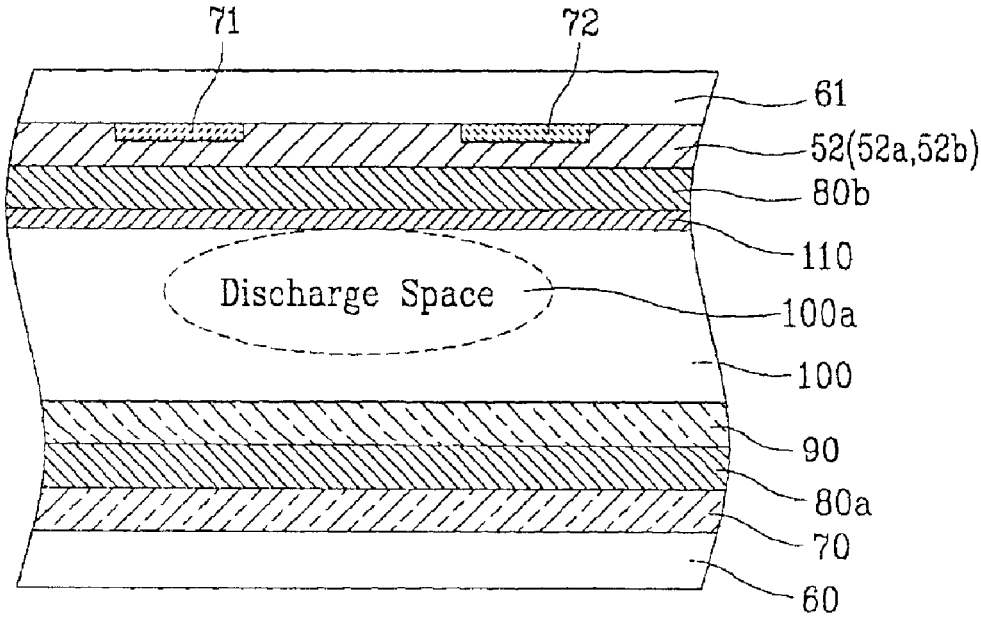
FIG. 12. is a partial cross-sectional view of a PDP according to the embodiment of the present invention of FIG. 11.

Continuing with reference to FIGS. 11 and 12, the PDP B1 of FIGS. 11 and 12 includes: a rear substrate 60 including a plurality of address electrodes 70 disposed on rear substrate, and a first dielectric layer 80*a* disposed on the rear substrate 60 and covering the address electrodes 70; spacers 100 located on the first dielectric layer 80*a* between the address electrodes 70 to create a discharge space or discharge spaces 100*a,* phosphor layers 90 formed on the first dielectric layer 80*a* in the corresponding discharge space or spaces 100*a;* a front substrate 61 including a plurality of scan electrodes 71 and common electrodes 72 disposed on the front substrate 61 in a direction transverse to the address electrodes 70; a filter layer 52 disposed on the front substrate 61 and covering the scan electrodes 71 and common electrodes 72, the filter layer 52 including nano-sized minute metal particulates adhered to a surface of oxide particles and the filter layer 52 providing at least one selective absorption for light peak at a predetermined wavelength of light by the induction of a surface plasma resonance (SPR) phenomenon at the interface between the metal particulates and the oxide particles; a second dielectric layer 80*b* disposed on the filter layer 52; and a protective layer 110 disposed on the second dielectric layer 80*b*.

Continuing with reference to FIGS. 11 and 12, a discharge gas is filled between the rear substrate 60 and the front substrate 61 in the discharge space or spaces 100*a,* and the rear substrate 60 and the front substrate 61 are sealed with respect to each other. When a pulse is applied to the electrodes, an address discharge occurs between an address electrode 70 on rear substrate 60 and a scan electrode 71 provided on front substrate 61 and a sustained surface-discharge occurs at the scan electrodes 71. Ultraviolet rays are produced by gas discharge to excite phosphors so that visible light is emitted therefrom to perform a display operation by the PDP B1.

The filter layer 52 on the front substrate 61 can include more than two kinds of metals and oxides with differing absorption peak wavelengths for light. Also, a plurality of filter layers 52*a,* 52*b* can form the filter layer 52 and can be applied on the surface of the face panel or front substrate 61, respectively providing absorption peaks for light at different wavelengths of light.

Figure 13:
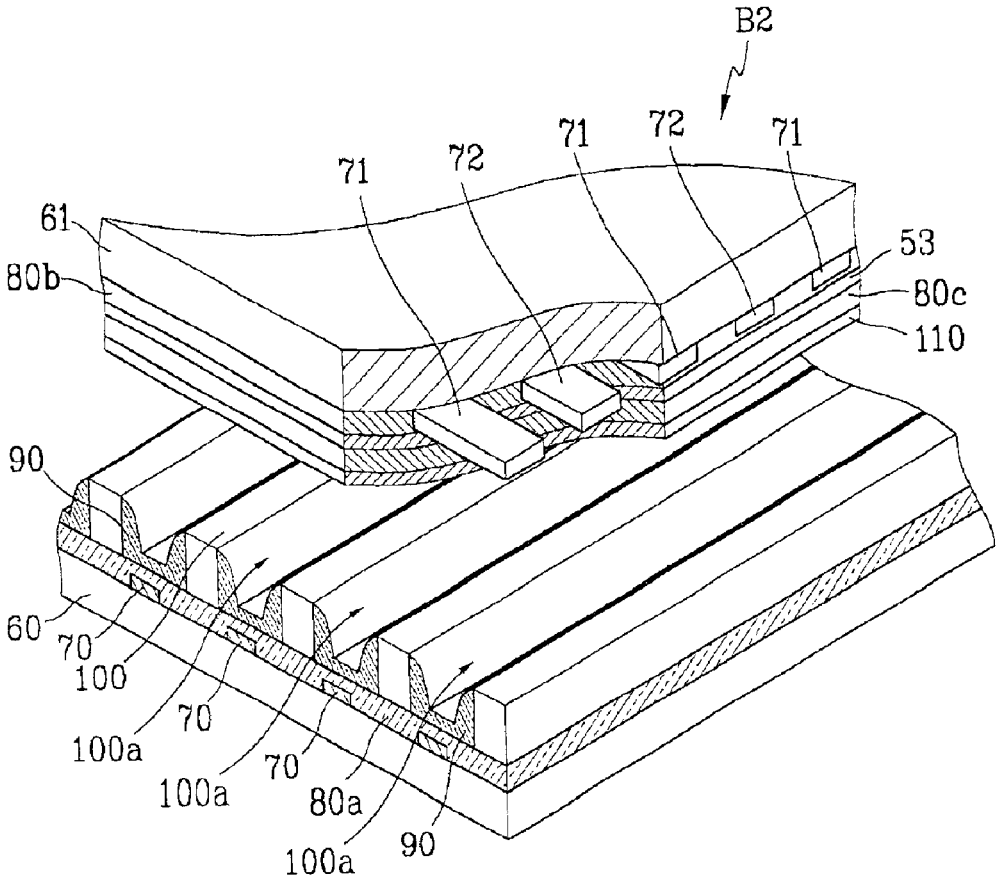
FIG. 13 is a partially exploded perspective view of a PDP according to another embodiment of the present invention.

In another preferred embodiment of a PDP according to the present invention, a filter layer according to the present invention is formed between second and third dielectric layers on a front substrate of a PDP. FIG. 13 illustrates a partially exploded perspective view of such embodiment of a PDP B2 and FIG. 14 illustrates a cross-sectional view of such embodiment of PDP B2 of FIG. 13.

Figure 14:
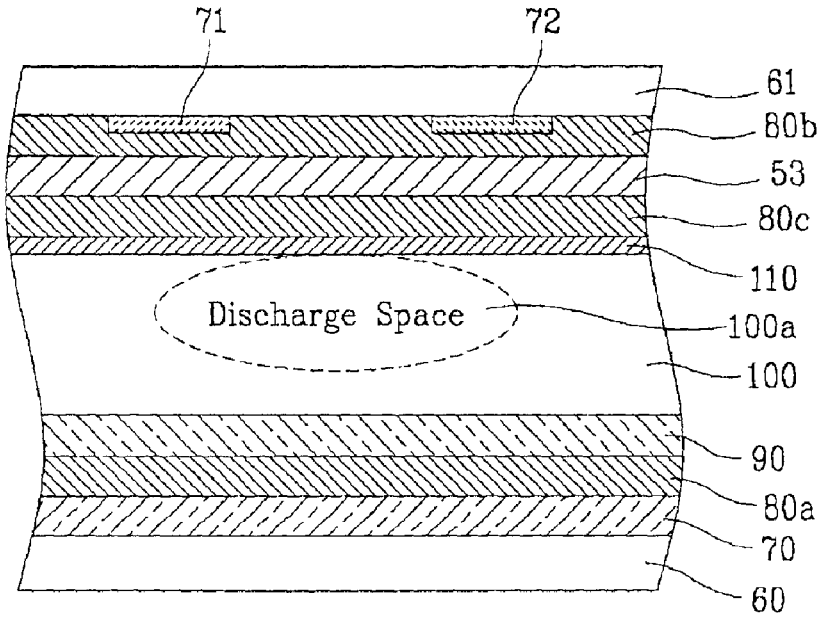
FIG. 14 is a partial cross-sectional view of a PDP according to the embodiment of the present invention of FIG. 13.

Referring to FIGS. 13 and 14, the PDP B2 includes: a rear substrate 60 including a plurality of address electrodes 70 disposed on the rear substrate 60, and a first dielectric layer 80*a* disposed on the rear substrate 60 and covering the address electrodes 70; spacers 100 located on the first dielectric layer 80*a* between the address electrodes 70 to create a discharge space or discharge spaces 100*a;* phosphor layers 90 formed on the first dielectric layer 80*a* in the discharge space or spaces 100*a;* a front substrate 61 including a plurality of scan electrodes 71 and common electrodes 72 disposed on the front substrate 61 in a direction transverse to the address electrodes 70, and a second dielectric layer 80*b* disposed on the front substrate 61 covering the scan electrodes 71 and common electrodes 72; a filter layer 53 disposed on the second dielectric layer 80*b* includes nano-sized minute metal particulates adhered to a surface of oxide particles, the filter layer 53 providing at least one selective absorption peak for light at a predetermined wavelength of light by the induction of a surface plasma resonance (SPR) phenomenon at the interface between the metal particulates and the oxide particles; a third dielectric layer 80*c* disposed on the filter layer 53; and a protective layer 110 disposed on the third dielectric layer 80*c*.

Figure 15:
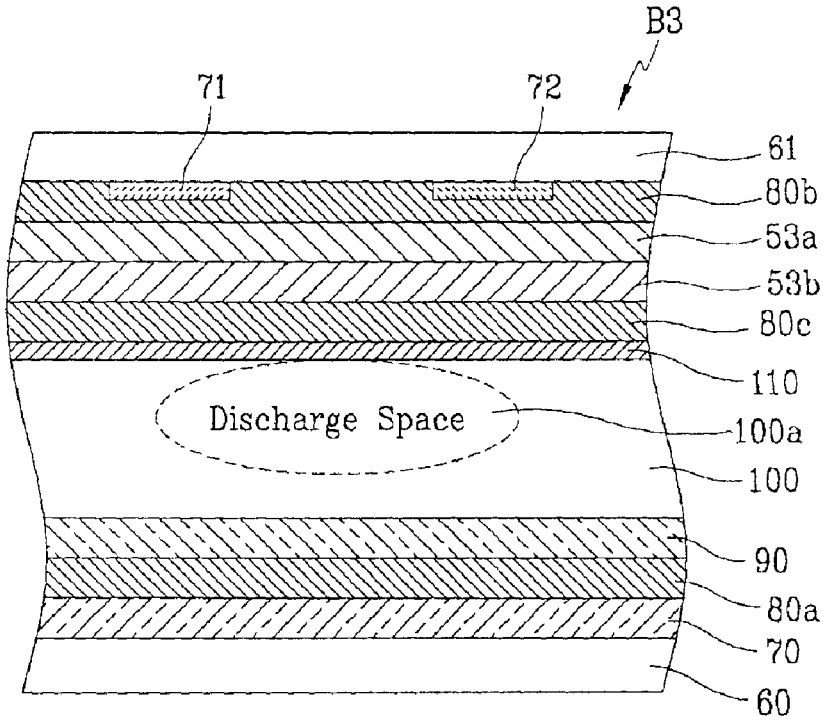
FIG. 15 is a partial cross-sectional view of a PDP according to another embodiment of the present invention.

The filter layer 53 between the second dielectric layer 80*b* and the third dielectric layer 80*c* can include more than two kinds of metals and oxides with differing absorption peak wavelengths for light. Also, in this regard, FIG. 15 is a cross-sectional view of another embodiment of a PDP B3 according to the present invention, similar to PDP B2 of FIGS. 13 and 14, and including similar components as described above with respect to PDP B2 of FIGS. 13 and 14. However, as illustrated in FIG. 15, a plurality of filter layers 53*a,* 53*b* according to the present invention can be applied between the second and third dielectric layers 80*b,* 80*c,* providing absorption peaks for light respectively at different wavelengths of light.

Figure 16:
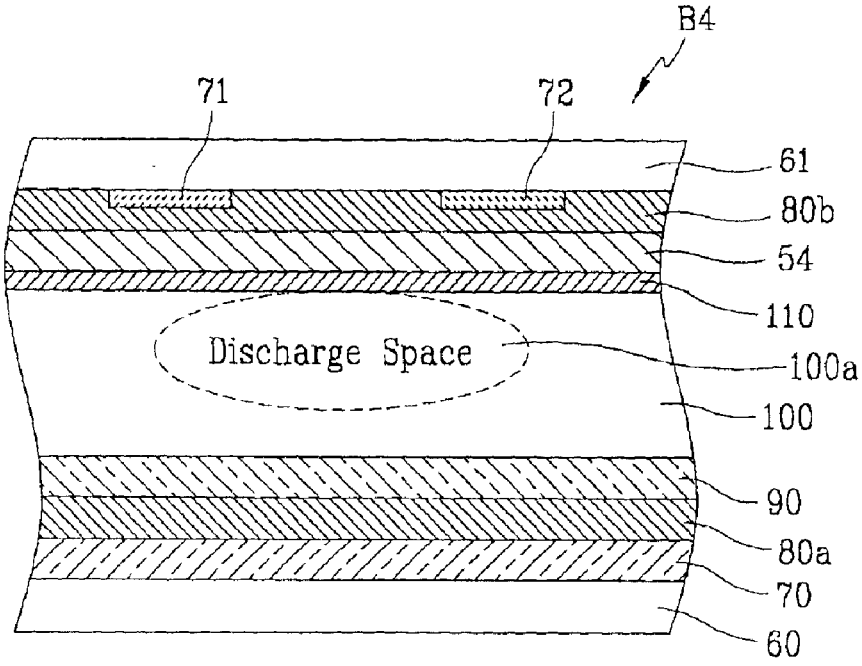
FIG. 16 is a partial cross-sectional view of a PDP according to another embodiment of the present invention.

In another preferred embodiment of the present invention, a filter layer is formed between a first dielectric layer and a protective layer of a PDP, and such embodiment of the present invention a is illustrated in FIG. 16 by a PDP B4.

In this regard, PDP B4 of FIG. 16 is similar in composition and structure as described above with respect to PDP B2 of FIGS. 13 and 14 except for the third dielectric layer 80*c,* and FIG. 16 is a cross-sectional view of the PDP B4 that includes; a rear substrate 60 including a plurality of address electrodes 70 disposed on rear substrate 60 similar to PDP B2; and a first dielectric layer 80*a* disposed on the rear substrate 60 and covering the address electrodes 70 similar to PDP B2; spacers 100 on the first dielectric layer 80*a* located between the address electrodes 70 to create a discharge space or discharge spaces 100*a;* phosphor layers 90 formed on the first dielectric layer 80*a* in the discharge space or spaces 100*a;* a front substrate 61 including a plurality of scan electrodes 71 and common electrodes 72 disposed on the front substrate 61 in a direction transverse to the address electrodes 70 similar to PDP B2, and a second dielectric layer 80*b* disposed on the front substrate 61 covering the scan electrodes 71 and common electrodes 72; a filter layer 54 disposed on the second dielectric layer 80*b* including nano-sized minute metal particulates adhered to a surface of oxide particles and the filter layer 54 providing at least one selective absorption peak for light at a predetermined wavelength of light by the induction of a surface plasma resonance (SPR) phenomenon at the interface between the metal particulates and the oxide particles; and a protective layer 110 disposed on the filter layer 54.

Figure 17:
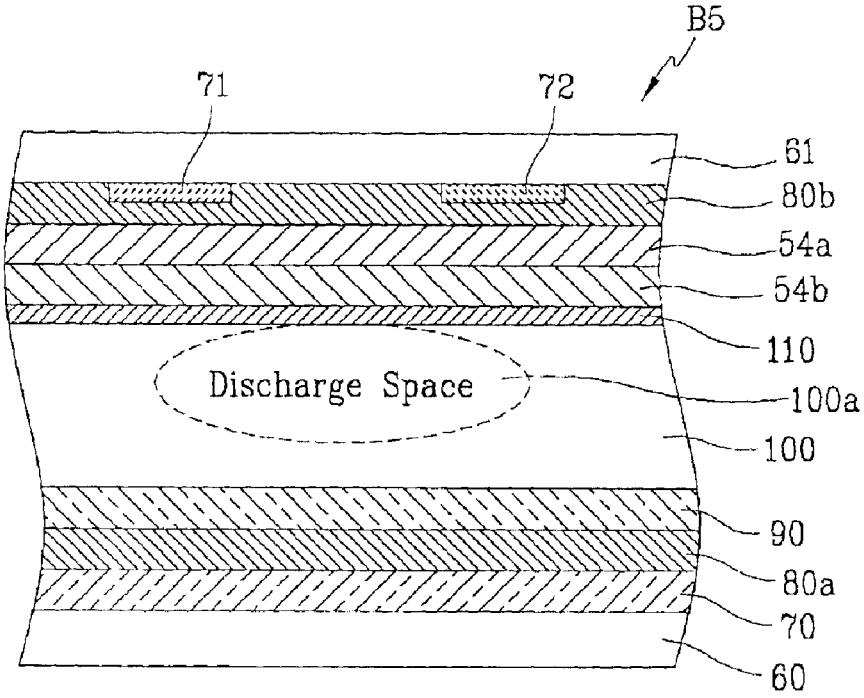
FIG. 17 is a partial cross-sectional view of a PDP according to another embodiment of the present invention.

Also, a filter layer or filter layers, such as filter layer 54 of FIG. 16, between the second dielectric layer 80*b* and the protective layer 110 can include more than two kinds of metals and oxides with differing absorption peak wavelengths. Also, in this regard, FIG. 17 is a cross-sectional view of another embodiment of a PDP B5 according to the present invention, similar in composition and structure as described above with respect to PDP B2 of FIGS. 13 and 14, except for the third dielectric layer 80*c,* and PDP B4 of FIG. 16. However, as illustrated in PDP B5 of FIG. 17, a plurality of filter layers 54*a,* 54*b* can be applied between the second dielectric layer 80*b* and the protective layer 110, providing absorption peaks for light respectively at different wavelengths of light.

Further, the filter layer or filter layers of the present invention as described above can serve as an infrared (IR) absorption shielding filter, discharge peak shielding filter, and so forth, for example.

The present invention is further explained in more detail with reference to the following examples. These examples, however, should not in any sense be interpreted as limiting the scope of the present invention.

EXAMPLES

Example 1

3.9 grams (g) of $Al_2O_3$ dispersed in water and 0.78 g of $TiO_2$ dispersed in water were mixed to prepare a solution including with $Al_2O_3/TiO_2$ in a mole ratio of 2/10. 15.32 g of water were added to the solution to prepare $Al_2O_3/TiO_2$ water-based sol. 0.2 g of $HAuCl_4$, 0.025 g of hydrazine, and 0.05 g of polyvinylbutyral were added to 14.57 g of ethanol, agitated and dissolved to prepare a gold colloid solution. 1.60 g of the gold colloid solution were added to the $Al_2O_3/TiO_2$ water-based sol to obtain the resultant coating solution with 0.035 mole % of gold on the basis of the oxide $Al_2O_3/TiO_2$.

A black matrix layer was formed on a 17-inch CRT face panel, and 20 ml of the coating solution was spin-coated on the face panel while the face panel was spinning at 150 revolutions per minute (rpm). The coated panel was dried at room temperature to form a filter layer. Next, a phosphor layer was formed on the panel in a conventional way. The thus-made panel is illustrated by the embodiment of the present invention of FIG. 4B.

Example 2

A CRT face panel was prepared in the same manner as described in Example 1, except that the content of the gold was 0.001 mole % on the basis of the oxide $Al_2O_3/TiO_2$.

Example 3

A CRT face panel was prepared in the same manner as described in Example 1, except that the content of the gold was 0.2 mole % on the basis of the oxide $Al_2O_3/TiO_2$.

Example 4

A CRT face panel was prepared in the same manner as described in Example 1, except that $HAuCl_4$ was replaced by $NaAuCl_4$.

Example 5

A CRT face panel was prepared in the same manner as described in Example 1, except that $HAuCl_4$ was replaced by $AuCl_3$.

Example 6

A CRT face panel was prepared in the same manner as described in Example 1, except that a $Al_2O_3/ZrO_2$ water-based sol was used instead of the $Al_2O_3/TiO_2$ water-based sol. The $Al_2O_3/ZrO_2$ water-based sol was prepared according the following method. 0.255 g of $Al_2O_3$ dispersed in water and 5.84 g of $ZrO_2$ dispersed in water were mixed to prepare a solution including $Al_2O_3/ZrO_2$ in a mole ratio of 0.5/9.5 and 13.905 g of water were added to the solution.

Example 7

A CRT face panel was prepared in the same manner as described in Example 1, except that the coating solution was coated on an outer surface of a face panel to form a filter layer. The thus-made panel is illustrated by the embodiment of the present invention of FIG. 7.

Example 8

A CRT face panel was prepared in the same manner as described in Example 1, except that $HAuCl_4$ was replaced by $NaAuCl_4$ and the coating solution was coated on the outer surface of a face panel to form a filter layer.

Example 9

A CRT face panel was prepared in the same manner as described in Example 1, except that $HAuCl_4$ was replaced by $AuCl_3$ and the coating solution was coated on the outer surface of a face panel to form a filter layer.

Example 10

2.5 g of indium tin oxide (ITO) having an average particle diameter of 80 nm were dispersed in a solvent consisting of 20 g of methanol, 67.5 g of ethanol and 10 g of n-butanol to prepare an ITO coating solution. 20 ml of the ITO coating solution was spin coated in the same way as in Example 1 and the coating solution prepared according to the Example 1 was additionally spin coated for the purpose of providing an embodiment of the present invention as illustrated in FIG. 8.

Example 11

A CRT face panel was prepared in the same manner as described in Example 10, except that $HAuCl_4$ was replaced by $NaAuCl_4$.

Example 12

A CRT face panel was prepared in the same manner as described in Example 10, except that $HAuCl_4$ was replaced by $AuCl_3$.

Example 13

A second coating solution was prepared in the same manner as described in Example 1, except that $HAuCl_4$ was replaced with $AgNO_3$ and the silver (Ag) content was 0.1 mole %. The coating solution prepared in Example 1 was spin-coated on a surface of a CRT face panel as a first coating solution and the second coating solution was spin-coated in the same way as in Example 1 to provide a plurality of filter layers for a display according to the present invention.

Example 14

The second coating solution prepared in Example 13 was coated on the inner surface of a CRT face panel made in Example 10 for the purpose of providing an embodiment of the present invention as illustrated in FIG. 9.

Example 15

A CRT face panel was prepared in the same manner as described in Example 1, except that $AgNO_3$ was used with $HAuCl_4$ and the silver and the gold contents were 0.035 and 0.1 mole %, respectively, based on the total moles of oxide.

Comparative Example 1

A CRT face panel was prepared by the same procedure as Example 1 except that a filter layer was not formed.

Figure 18:
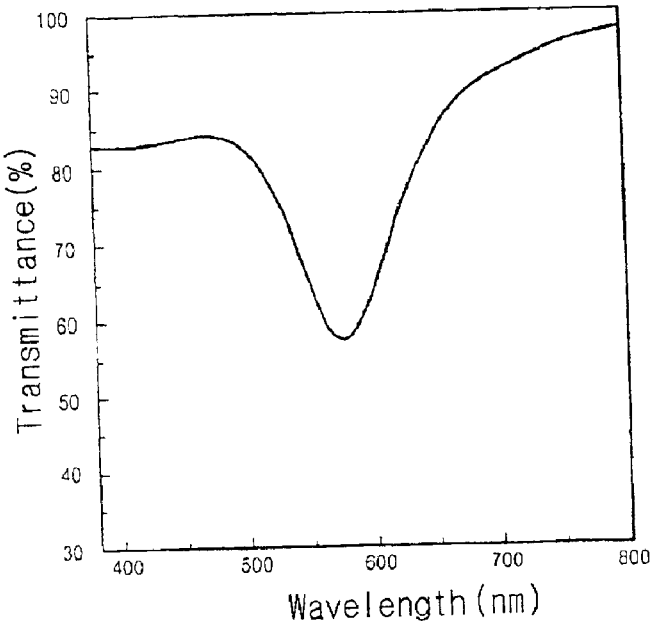
FIG. 18 is a graph of a spectral transmission distribution of a filter containing CRT according to the embodiment of the present invention of FIG. 4A, for example.
Figure 19:
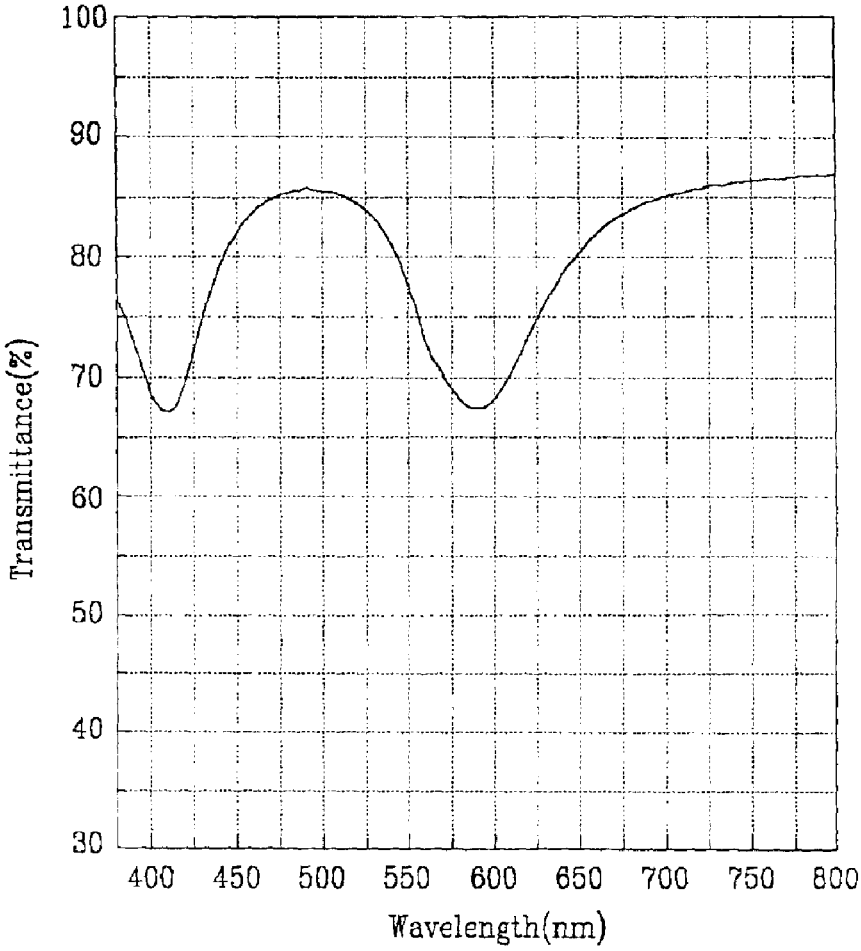
FIG. 19 is a graph of a spectral transmission distribution of a filter containing CRT according to the embodiment of the present invention of FIG. 6, for example.

A CRT including the face panel of Example 1 had an absorption peak at 580 nm as shown in FIG. 18. Cathode ray tubes (CRTs) including the face panel of Examples 2 through 12 each had an absorption peak at 580 nm. CRTs including the face panel of Examples 13 had two main absorption peaks at 580 nm and 410 nm as shown in FIG. 19. Cathode ray tubes (CRTs) including the face panel of Examples 14 and 15 had two main absorption peaks at 580 nm and 410 nm. These absorption peaks illustrate the occurrence of surface plasma resonance at the interface of metal particulates and oxide particles in the filter layer or filter layers according to the present invention. In contrast, a CRT including the face panel of Comparative Example 1 had no significant absorption peak.

The contrast of CRTs including the face panels of the above Examples and the above Comparative Example was evaluated under the condition of the following: voltage=Eb=27.5 kV, current=Ib=600 $\mu$A, color coordinates of 283/298 based on the Internal Commission on Elumination (CIE) chomaticity diagram. The brightness of the CRT including the respective face panels of Examples 1 through 3 and of Comparative Example 1 was measured when power was applied. When the power was turned off and reflections of ambient light were 400 lux and 600 lux, respectively, the brightness was measured and the resulting brightness is illustrated in the following Table 1.

TABLE 1

| | Brightness when supplying power (fL) | Brightness at 400 lux (fL) | Brightness at 600 lux (fL) | Relative contrast (%) |
|---|---|---|---|---|
| Example 1 | 35.8 | 0.630 | 1.02 | 115 |
| Example 2 | 35.4 | 0.637 | 1.103 | 112 |
| Example 3 | 35.7 | 0.615 | 0.985 | 116 |
| Comparative Example 1 | 35.8 | 0.7245 | 1.173 | 100 |

The unit 'fL' means foot-Lambert, as a unit of brightness in the above Table 1. As shown in Table 1, the contrast of CRTs according to Examples 1 through 3 increases by more than about 12% compared to that of the Comparative Example 1.

The color coordinate range of the CRT according to the above described Example 1 according to the present invention was measured to have 644/315 of red and 143/058 of blue based on the International Commission on Elumination (CIE) chomaticity diagram. Such result illustrates an improvement of above 5% compared to that of the conventional CRT.

Example 16

1.95 g of $Al_2O_3$ dispersed in water and 0.78 g of $TiO_2$ dispersed in water were mixed to prepare a solution including $Al_2O_3/TiO_2$ in a mole ratio of 1/10. 17.27 g of water were added to the solution to prepare a $Al_2O_3/TiO_2$ water-based sol. 0.2 g of $HAuCl_4$, 0.025 g of hydrazine, and 0.05 g of polyvinylbutyral were added to 14.57 g of ethanol, agitated and dissolved to prepare a gold colloid solution. 1.60 g of the gold colloid solution were added to the $Al_2O_3/TiO_2$ water-based sol to obtain the resultant coating solution with 0.035 mole % of gold on the basis of the oxide $Al_2O_3/TiO_2$.

A plurality of scan electrodes and common electrodes were disposed on a front substrate and 20 ml of the coating solution of the Example 16 was spin-coated on the front substrate, while the front substrate was spinning at 150 rpm. The coated front substrate was dried at room temperature to form a filter layer. Next, a dielectric layer and a protective layer were formed in a conventional way. The thus-made coated front substrate is illustrated by the embodiment of the present invention of FIGS. 11 and 12.

Example 17

A front substrate for a PDP was prepared in the same manner as described in Example 16, except that the content of the gold was 0.001 mole % on the basis of the oxide $Al_2O_3/TiO_2$.

Example 18

A front substrate for a PDP was prepared in the same manner as described in Example 16, except that the content of the gold was 0.2 mole % on the basis of the oxide $Al_2O_3/TiO_2$.

Example 19

A front substrate for a PDP was prepared in the same manner as described in Example 16, except that $HAuCl_4$ was replaced by $NaAuCl_4$.

Example 20

A front substrate for a PDP was prepared in the same manner as described in Example 16, except that $HAuCl_4$ was replaced by $AuCl_3$.

Figure 20:
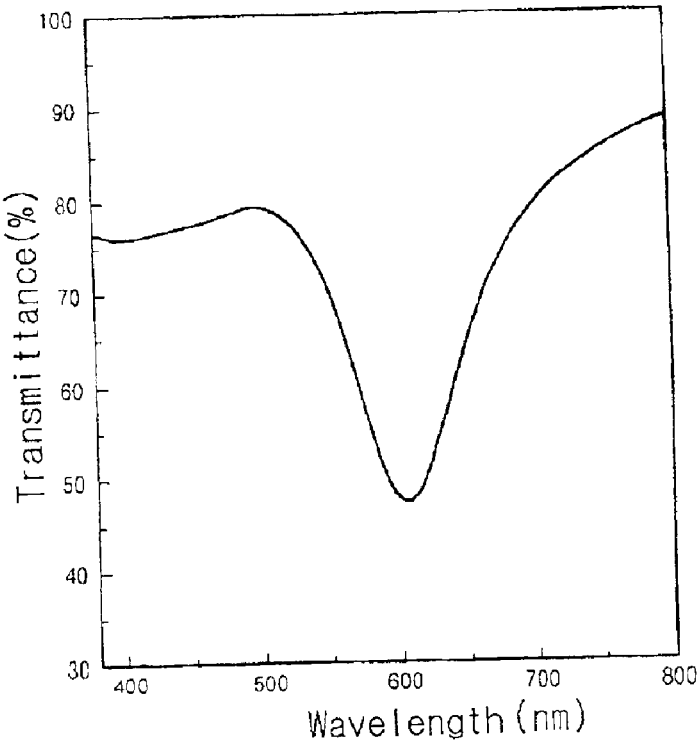
FIG. 20 is a graph of a spectral transmission distribution of a filter containing PDP according to the embodiment of the present invention of FIGS. 11 and 12, for example.

A PDP including the front substrate of the above described Example 16 had an absorption peak at 580 nm as illustrated in FIG. 20. Plasma display panels (PDPs) including the front substrate of the above described Examples 17 through 20 each had an absorption peak at 580 nm. This absorption peak illustrates the occurrence of surface plasma resonance (SPR) at the interface of the metal particulates and the oxide particles in a filter layer or filter layers according to the present invention.

The filter layer or filter layers of the present invention absorb light in the overlapping wavelengths among RGB phosphors, and thus reduce reflection on the panel for a display. A sintering process advantageously is not required, since a reduced metal and a water-based oxide sol are used. Additional explosion proof equipment is also advantageously not required because the water-based sol is used instead of an alcohol-based sol. A filter layer of the present invention is formed by drying the coated panel at room temperature through a sol-gel process. The absorption intensity and wavelength of a filter layer according to the present inventions can be adjusted by controlling the kind, or type, and contents of a metal and the size of a metal particulate, or the kind, or type, and contents of an oxide, more easily than in a conventional method where dyes or pigments are typically used.

While there have been illustrated and described what are considered to be preferred embodiments of the present invention, it will be understood by those skilled in the art that various changes and modifications may be made, and equivalents may be substituted for elements thereof, without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention include all embodiments falling within the scope of the appended claims.

What is claimed is:

1. A cathode ray tube, comprising:

a face panel;

at least one filter layer formed on an inner surface of said face panel, said at least one filter layer comprising oxide particles and nano-sized metal particulates adhered to a surface of the oxide particles with a surface plasma resonance phenomenon being triggered at corresponding interfaces of the nano-sized metal particulates and the oxide particles to selectively absorb light at least at one predetermined wavelength of light; and a phosphor layer formed on a filter layer of said at least one filter layer.

2. The cathode ray rube of claim 1, wherein said at least one filter layer provides at least one selective absorption peak for light at a corresponding predetermined wavelength of light by induction of the surface plasma resonance phenomenon at the corresponding interfaces between the nano-sized metal particulates and the oxide particles.

3. The cathode ray rube of claim 2, said at least one filter layer including a plurality of kinds of metals and oxides for the nano-sized metal particulates and the oxide particles to provide a plurality of differing selective absorption peaks for corresponding wavelengths of light.

4. The cathode ray rube of claim 2, said at least one filter layer including a plurality of filter layers, each being formed to respectively provide a plurality of selective absorption peaks for light at corresponding different wavelengths of light.

5. The cathode ray rube of claim 1, wherein said at least one filter layer is formed on an outer surface of said face panel.

6. The cathode ray rube of claim 5, said at least one filter layer including a plurality of kinds of metals and oxides for the oxide particles and the nano-sized metal particulates to provide a plurality of differing selective absorption peaks for corresponding wavelengths of light.

7. The cathode ray rube of claim 5, said at least one filter layer including a plurality of filter layers formed to respectively provide a plurality of selective absorption peaks for light at corresponding different wavelengths of light.

8. The cathode ray rube of claim 5, further comprising a conductive film located between the outer surface of said face panel and a filter layer of said at least one filter layer.

9. The cathode ray rube of claim 5, said at least one filter layer providing an anti-reflection layer.

10. A cathode ray tube, comprising:

a face panel;

at least one first filter layer formed on an inner surface of the face panel;

at least one second filter layer formed on an outer surface of the face panel; and a phosphor layer formed on a filter layer of said at least one first filter layer, said at least one first filter layer and said at least one second filter layer each comprising oxide particles and nano-sized metal particulates adhered to a surface of the oxide particles, said at least one first filter layer and said at least one second filter layer each providing at least one selective absorption peak for light at a corresponding predetermined wavelength of light by induction of a surface plasma resonance phenomenon at corresponding interfaces between the nano-sized metal particulates and the oxide particles.

11. The cathode ray rube of claim 10, wherein any of said at least one first filter layer and said at least one second filter layer includes a plurality of metals and oxides for the oxide particles and the nano-sized metal particulates to provide a plurality of differing selective absorption peaks for corresponding wavelengths of light.

12. The cathode ray rube of claim 10, wherein any of said at least one first filter layer and said at least one second filter layer includes a plurality of filter layers formed to respectively provide a plurality of selective absorption peaks for light at corresponding different wavelengths of light.

13. The cathode ray tube of claim 10, further comprising a conductive film located between the outer surface of the face panel and a filter layer of said at least one second filter layer.

14. The cathode ray tube of claim 10, said at least one second filter layer providing an anti-reflection layer.

15. A plasma display panel, comprising:

a rear substrate including a plurality of address electrodes disposed on the rear substrate, and a first dielectric layer disposed on the rear substrate and covering the plurality of address electrodes;

a plurality of spacers disposed on the first dielectric layer, adjacent ones of said plurality of spacers being respectively positioned in opposing relation with respect to an address electrode of said plurality of address electrodes to provide a corresponding discharge space;

a plurality of phosphor layers disposed on the first dielectric layer, each of said plurality of phosphor layers being respectively formed in a corresponding discharge space provided by adjacent ones of said plurality of spaces;

a front substrate including a plurality of scan electrodes and a plurality of common electrodes disposed on the front substrate in a direction transverse to a direction of said plurality of address electrodes;

at least one filter layer disposed on said front substrate and covering the plurality of scan electrodes and the plurality of common electrodes, said at least one filter layer comprising oxide particles and nano-sized metal particulates adhered to a surface of the oxide particles, said at least one filter layer providing at least one selective absorption peak for light at a corresponding predetermined wavelength of light by induction of a surface plasma resonance phenomenon at corresponding interfaces between the nano-sized metal particulates and the oxide particles;

a second dielectric layer disposed on a filter layer of said at least one filter layer; and a protective layer disposed on said second dielectric layer.

16. The plasma display panel of claim 15, said at least one filter layer including a plurality of kinds of metals and oxides for the oxide particles and the nano-sized metal particulates to provide a plurality of differing selective absorption peaks for corresponding wavelengths of light.

17. The plasma display panel of claim 15, said at least one filter layer including a plurality of filter layers formed to respectively provide a plurality of selective absorption peaks for light at corresponding different wavelengths of light.

18. A plasma display panel, comprising:

a rear substrate including a plurality of address electrodes disposed on the rear substrate, and a first dielectric layer disposed on the rear substrate and covering the plurality of address electrodes;

a plurality of spacers disposed on the first dielectric layer, adjacent ones of said plurality of spacers being respectively positioned in opposing relation with respect to an address electrode of said plurality of address electrodes to provide a corresponding discharge space;

a plurality of phosphor layers disposed on the first dielectric layer, each of said plurality of phosphor layers being respectively formed in a corresponding discharge space provided by adjacent ones of said plurality of spacers;

a front substrate including a plurality of scan electrodes and a plurality of common electrodes disposed on the front substrate in a direction transverse to a direction of said plurality of address electrodes, and a second dielectric layer disposed on said front substrate and covering said plurality of scan electrodes and said plurality of common electrodes;

at least one filter layer disposed on the second dielectric layer, said at least one filter layer comprising oxide particles and nano-sized metal particulates adhered to a surface of the oxide particles, said at least one filter layer providing at least one selective absorption peak for light at a corresponding predetermined wavelength of light by induction of a surface plasma resonance phenomenon at corresponding interfaces between the nano-sized metal particulates and the oxide particles;

a third dielectric layer disposed on a filter layer of said at least one filter layer; and a protective layer disposed on said third dielectric layer.

19. The plasma display panel of claim 18, said at least one filter layer including a plurality of kinds of metals and oxides for the oxide particles and the nano-sized metal particulates to provide a plurality of differing selective absorption peaks for corresponding wavelengths of light.

20. The plasma display panel of claim 18, said at least one filter layer including a plurality of filter layers formed to respectively provide a plurality of selective absorption peaks for light at corresponding different wavelengths of light.

21. A plasma display panel, comprising:

a rear substrate including a plurality of address electrodes disposed on the rear substrate, and a first dielectric layer disposed on the rear substrate and covering the plurality of address electrodes;

a plurality of spacers disposed on the first dielectric layer, adjacent ones of the plurality of spacers being respectively positioned in opposing relation with respect to an address electrode of said plurality of address electrodes to provide a corresponding discharge space;

a plurality of phosphor layers disposed on the first dielectric layer, each of said plurality of phosphor layers being respectively formed in a corresponding discharge space provided by adjacent ones of said plurality of spacers;

a front substrate including a plurality of scan electrodes and a plurality of common electrodes disposed on the front substrate in a direction transverse to a direction of said plurality of address electrodes, and a second dielectric layer disposed on said front substrate and covering said plurality of scan electrodes and said plurality of common electrodes;

at least one filter layer disposed on said second dielectric layer, said at least one filter layer comprising oxide particles and nano-sized metal particulates adhered to a surface of the oxide particles, said at least one filter layer providing at least one selective absorption peak for light at a corresponding predetermined wavelength of light by induction of a surface plasma resonance phenomenon at corresponding interfaces between the nano-sized metal particulates and the oxide particles; and a protective layer disposed on a filter layer of said at least one filter layer.

22. The plasma display panel of claim 21, said at least one filter layer including a plurality of kinds of metals and oxides for the oxide particles and the nano-sized metal particulates to provide a plurality of differing selective absorption peaks for corresponding wavelengths of light.

23. The plasma display panel of claim 21, said at least one filter layer including a plurality of filter layers formed to respectively provide a plurality of selective absorption peaks for light at corresponding different wavelengths of light.

* * * * *